US007548134B2

(12) United States Patent
Park et al.

(10) Patent No.: US 7,548,134 B2
(45) Date of Patent: Jun. 16, 2009

(54) TRANSMISSION LINE TRANSFORMER

(75) Inventors: Changkun Park, Gyeongsangnam-do (KR); Younsuk Kim, Daejeon (KR); Songcheol Hong, Daejeon (KR)

(73) Assignee: Korea Advanced Institute of Science and Technology, Daejon (KR)

( * ) Notice: Subject to any disclaimer, the term of this patent is extended or adjusted under 35 U.S.C. 154(b) by 254 days.

(21) Appl. No.: 11/400,205

(22) Filed: Apr. 10, 2006

(65) Prior Publication Data

US 2006/0232355 A1 Oct. 19, 2006

(30) Foreign Application Priority Data

Apr. 14, 2005 (KR) ..... 10-2005-0031070

(51) Int. Cl.
*H01P 5/02* (2006.01)
*H01P 5/10* (2006.01)
*H01P 5/12* (2006.01)

(52) U.S. Cl. ..... 333/24 R; 333/26; 333/33

(58) Field of Classification Search ..... 333/25, 333/26, 33, 24 R

See application file for complete search history.

(56) References Cited

U.S. PATENT DOCUMENTS 6,420,942 B1 * 7/2002 Hiroshima et al. ..... 333/26
6,522,201 B1 2/2003 Hsiao et al.
7,199,684 B2 * 4/2007 Aigner et al. ..... 333/189

OTHER PUBLICATIONS

A. Shirvani, et al., "A CMOS RF Power Amplifier with Parallel Amplification for Efficient Power Control." IEEE J. Solid-State Circuits, vol. 37, No. 6, pp. 684-693, Jun. 2002.

* cited by examiner

*Primary Examiner*—Benny Lee
*Assistant Examiner*—Gerald Stevens
(74) *Attorney, Agent, or Firm*—Oliff & Berridge, PLC

(57) ABSTRACT

A transmission line transformer is disclosed. The transformer improves efficiency and a dynamic range of a power amplifier. The transformer is formed to have a plurality of load impedances as the primary side of the transmission line transformer is separated to form a plurality of primary transmission lines with parasitic components which are different from each other. The transformer is used as an impedance matching circuit of the power amplifier requiring a plurality of load impedances.

5 Claims, 6 Drawing Sheets

(a)

(b)

TRANSMISSION LINE TRANSFORMER

BACKGROUND OF THE INVENTION

1. Field of the Invention

The present invention relates to a transformer, and more particularly to a transmission line transformer which is capable of improving efficiency and a dynamic range of a power amplifier, and which is formed to have a plurality of load impedances as the primary side of the transmission line transformer is separated to form a plurality of primary transmission lines with parasitic components which are different from each other, in which the transmission line transformer is used as an impedance matching circuit of the power amplifier requiring a plurality of load impedances.

2. Description of the Related Art

Generally, a power amplifier requiring a plurality of load impedances is usually used in a wireless communication system.

FIG. 1 is a schematic block diagram of a power amplifier of a general art, or a power amplifier with a polar structure which is a type of wireless communication system.

In general, a power amplifier with a Class E output stage structure which is used in a polar structure guarantees its dynamic range as its source voltage VDD is adjusted. The output power of the power amplifier can be expressed as following Equation (1):

$$P_{out} \propto \frac{VDD^2}{R_{load}} \tag{1}$$

Where Pout denotes output power, VDD denotes a source voltage, and $R_{load}$ denotes a load impedance.

As described in Equation (1), when the source voltage VDD is controlled, the output power Pout is changed. However, the conventional power amplifier has disadvantages in that its sufficient dynamic range cannot be guaranteed by only control of the source voltage VDD.

FIG. 2 is a graph describing a dynamic range based on a source voltage of a non-linear power amplifier of a general art, in which the dynamic range can be extended as the load impedance is controlled.

For example, as described in Equation (1), the Class E output stage of the conventional determines its dynamic range according to change of the source voltage VDD. Namely, when the source voltage is changed from 0.6V to 3.3V, the dynamic range of the power amplifier is 16.4 dB based on Equation (1).

However, the wireless communication system requires a relatively wide dynamic range. Therefore, to comply with such a request, when the source voltage VDD is less than a source voltage VDD of point 203 which is a point where load impedance $R_{load}$ is increased, if load impedance $R_{load}$ is increased, the dynamic range is extended as reference numerals 201 and 202 indicated.

As described in Equation (1), a dynamic range is generally extended as load impedance is increased at less than a predetermined source voltage VDD.

Also, the greater the load impedance in a low output power region, the more efficiency of the power amplifier is increased. Namely, when the load impedance value is increased in the low output power region, the dynamic range and efficiency of the power amplifier are increased.

However, since load impedance $R_{load}$ of the conventional power amplifier is set to a proper value to meet with the maximum value of the output power Pout, the power amplifier decreases its efficiency in a region where a relatively low output power is outputted.

Therefore, a plurality of load impedances is installed in the power amplifier in order to resolve the problems.

Of the methods where the power amplifier has a plurality of load impedances installed, there is a method wherein the final stage of the power amplifier is separated into plural parts. Namely, the plural parts are divided into a high output power part, a middle output power part and a low output power part.

Here, the high, middle, and low output power parts are configured with impedance matching circuits which have load impedances complying with high, middle, and low output powers, respectively.

Therefore, the amplifier is operated such that: when requiring high output power, all of the three parts are turned on; when requiring middle output power, the high output power part is turned off and the other parts are tuned on; and when requiring low output power, the high and middle output power parts are turned off and the low output power part is turned on.

As such, since the part for outputting low output is configured with an impedance matching circuit with load impedances to comply with low power, efficiency of the power amplifier is increased. Therefore, the power amplifier has characteristics that its efficiency is high in the whole range of output power.

Such a method was disclosed in a journal, "A. Shirvani, et al., 'A CMOS RF Power Amplifier With Parallel Amplification for Efficient Power Control,' IEEE J. Solid-State Circuits, vol. 37, no. 6, pp. 684-693, June 2002."

In order to output the respective output powers, an amplification stage of a power amplifier of a general art can be divided into a low output power part and a high output power part, as shown in FIG. 3. Namely, the low and high output power parts are configured with low and high output power impedance matching circuits each of which has different load impedance.

Namely, the parts for outputting high and low powers are configured with load impedances to comply with high and low powers, respectively. Therefore, the part for outputting high power can be turned off if the power amplifier outputs low output power.

As such, the amplification stage of the power amplifier is divided into two parts to have two load impedances, configured as two impedance matching circuits. Here, reference numerals 303 and 304 denote amplifiers for high and low powers in the power amplifier, respectively. The respective amplifiers are connected to the impedance matching circuit 302. Namely, the amplifiers for high and low powers are connected to the high and low output power impedance matching circuits, respectively.

Therefore, the conventional power amplifier can improve its efficiency and dynamic range as it is operated such that: the amplifier 303 for high power and the high output power impedance matching circuit connected thereto are turned on, and the amplifier 304 for low power and the low output power impedance matching circuit connected thereto are turned off, when high power is needed; and the amplifier 303 and the high output power impedance matching circuit connected thereto are turned off, and the amplifier 304 and the low output power impedance matching circuit connected thereto are turned on, when low power is needed.

However, the method disclosed in the above-mentioned journal has disadvantages in that it requires additional switches such that another turned on amplification stage can have a desired load impedance when a part of the amplification stage is turned off, and also its circuit size can be increased since the size of the switches is similar to that of a power transistor in the amplification stage.

Also, the conventional power amplifier has drawbacks in that, since it adopts a structure of Class F output stage (a type of Class F power amplifier), the size of its entire circuit can be decreased only if the operation frequency is greater than tens of gigahertz.

SUMMARY OF THE INVENTION

Therefore, the present invention has been made in view of the above problems, and it is an object of the present invention to provide a transmission line transformer which is capable of improving efficiency and a dynamic range of a power amplifier, and which is formed to have a plurality of load impedances as the primary side of the transmission line transformer is separated to form a plurality of primary transmission lines with parasitic components which are different from each other, in which the transmission line transformer is used as an impedance matching circuit of the power amplifier requiring a plurality of load impedances.

In accordance with an aspect of the present invention, the above and other objects can be accomplished by the provision of a transmission line transformer comprising: a secondary transmission line; and a plurality of primary transmission lines which are correspondingly aligned at both sides of the secondary transmission line, in which the primary transmission lines have parasitic components which are different from each other, respectively.

Preferably, the plurality of primary transmission lines has cross-sectional areas which are different from each other.

Preferably, the plurality of primary transmission lines and the secondary transmission line are coupled to each other with coupling factors which are different from each other.

Preferably, the plurality of primary transmission lines has lengths which are different from each other.

Preferably, the secondary transmission line is formed in a bent shape so that inside and outside are aligned with the plurality of primary transmission lines, respectively.

Preferably, one of the plurality of primary transmission lines is formed as a bent shape.

The transmission line transformer according to the present invention can improve efficiency and a dynamic range of a power amplifier as its primary side is separated to form a plurality of primary transmission lines with parasitic components which are different from each other, in which the transmission line transformer is used as an impedance matching circuit of the power amplifier requiring a plurality of load impedances.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

While the invention has been shown and described with respect to the preferred embodiments, it will be understood by those skilled in the art that various changes and modifications may be made without departing from the scope and spirit of the invention. Thus, the scope of the invention should not be limited by the embodiments of the present invention.

Figure 4:
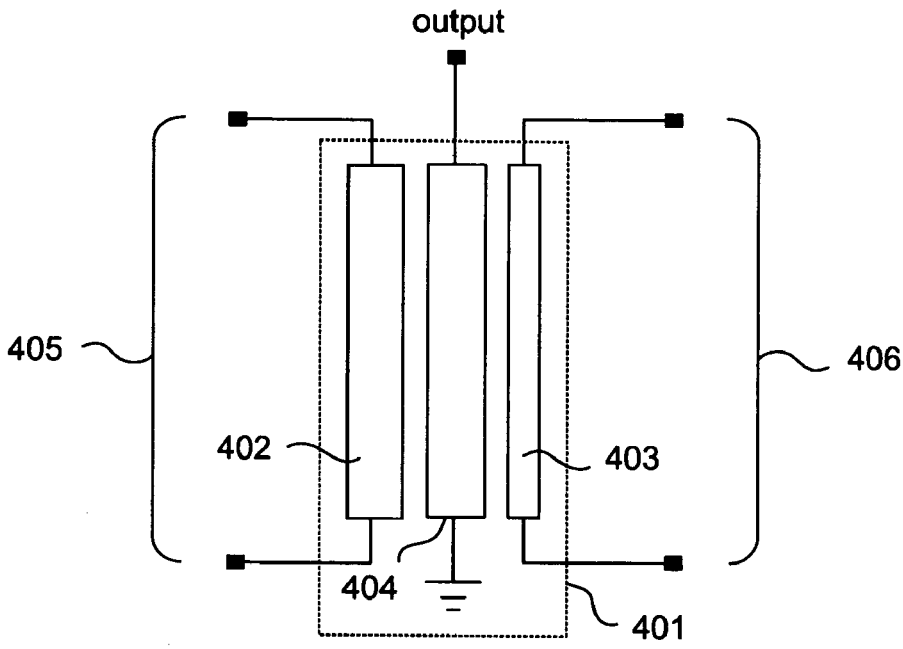
FIG. 4A is a circuit diagram of a transmission line transformer according to the present invention.
FIG. 4B is a view illustrating a structure of the transmission line transformer according to the present invention.
Figure 4:
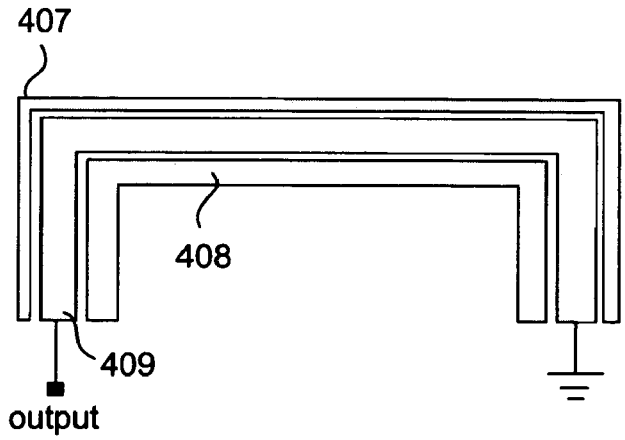

FIG. 4A is a circuit diagram of a transmission line transformer according to the present invention, and FIG. 4B is a view illustrating a structure of the transmission line transformer according to the present invention.

As shown in FIG. 4A, the transmission line transformer includes a secondary transmission line 404, and a plurality of primary transmission lines 402 and 403 which are correspondingly aligned at both sides of the secondary transmission line 404, respectively, in which the primary transmission lines have parasitic components which are different from each other.

Here, the plurality of primary transmission lines 402 and 403 have cross-sectional areas which are different from each other, and couple to the secondary transmission line 404, with coupling factors which are different from each other.

On the other hand, as shown in FIG. 4B, a plurality of primary transmission lines 408 and 407 of the transmission line transformer can be bent in a bent shape of a secondary transmission line 409, in which the primary transmission lines 408 and 407 have lengths which are different from each other to be aligned in the inside and the outside of the bent secondary transmission line 409, respectively.

More specifically, the primary transmission line 408 for high power is relatively shorter than the primary transmission line 407 for low power, such that the primary transmission line 408 for high power is located at the inside of the secondary transmission line 409, and the primary transmission line 407 for low power is positioned at the outside of the secondary transmission line 409. Therefore, inductance of the primary 407 transmission lines is increased. In addition, when width of the primary transmission line 407 for low power is decreased, its inductance can be further increased. Therefore, such a connection circuit can be an efficient impedance matching circuit using an additional capacitor and a parasitic drain-source capacitor of a transistor, which is connected to the transmission line transformer.

Figure 5:
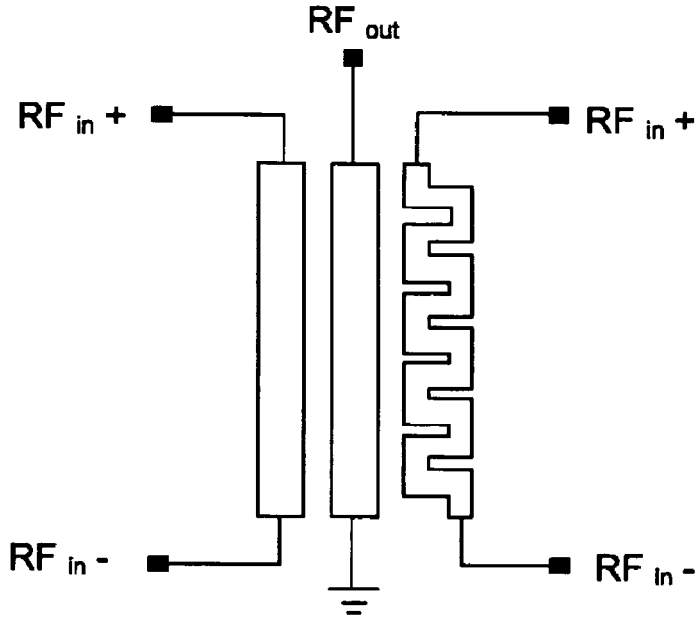
FIG. 5 is a view illustrating a structure of the transmission line transformer according to an embodiment of the present invention.

On the other hand, as shown in FIG. 5, the transmission line transformer may be modified such that, where the transformer has inputs ($RF_{in}$) and output ($RF_{out}$), one of the plurality of primary transmission lines is formed in a plural bent shape, in which the bent transmission line is relatively longer than the others.

Figure 6:
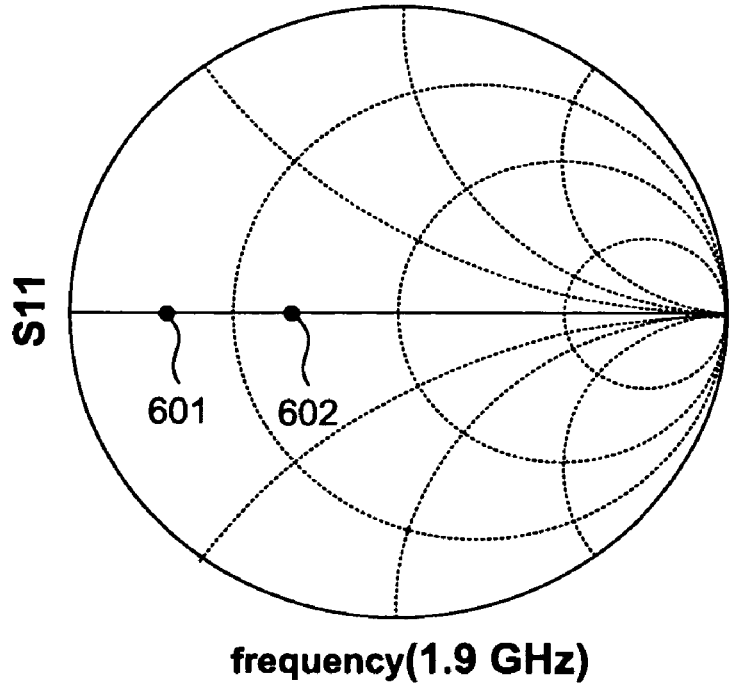
FIG. 6 is a graph illustrating a computer simulation result for a transmission line transformer according to the present invention.

FIG. 6 is a graph illustrating a computer simulation result for a transmission line transformer according to the present invention. Namely, reference numeral 601 is related to a simulation result with respect to parameter S11 of the primary transmission line 408 for high power, and reference numeral 602 is related to a simulation result with respect to parameter S11 of the primary transmission line 407 for low power.

When the transmission line transformers of FIG. 4A and FIG. 4B are used in the matching circuit with the parasitic capacitance of the transistors therein and capacitance of an additional capacitor, it will be appreciated that the transmission line transformer according to the present invention can simultaneously have load impedances for high power and low power.

Figure 1:
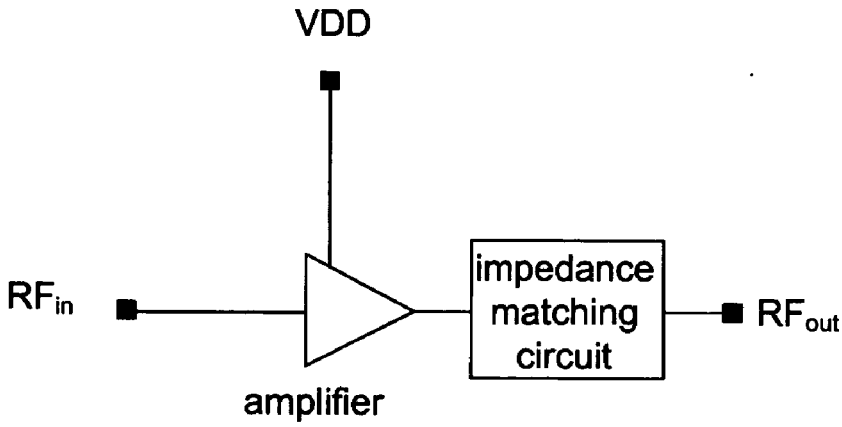
Fig. 1 (Prior Art)
FIG. 1 is a schematic block diagram of a power amplifier of a general art.
Figure 2:
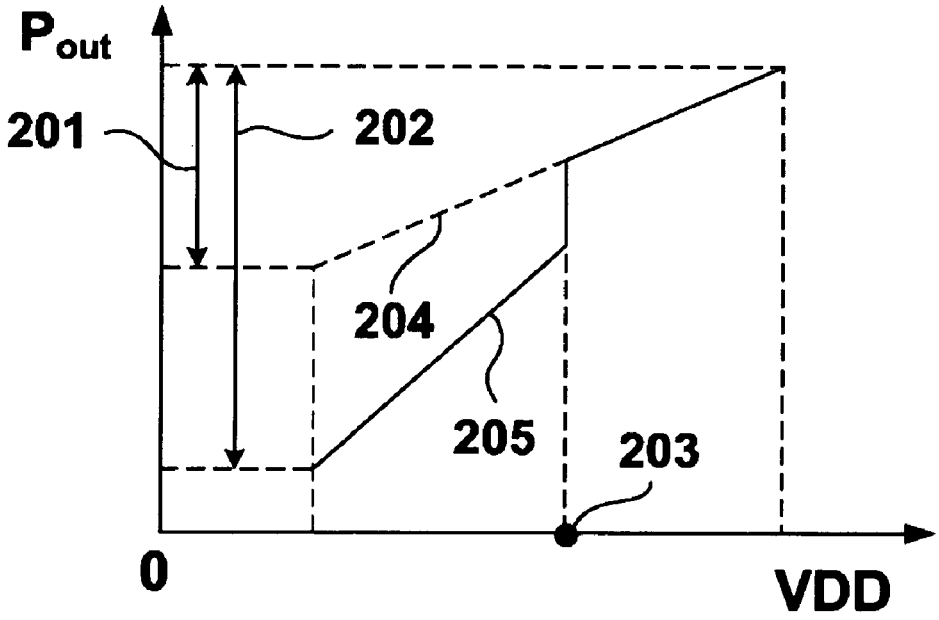
Fig. 2 (Prior Art)
FIG. 2 is a graph describing a dynamic range based on a source voltage of a non-linear power amplifier of a general art.
Figure 3:
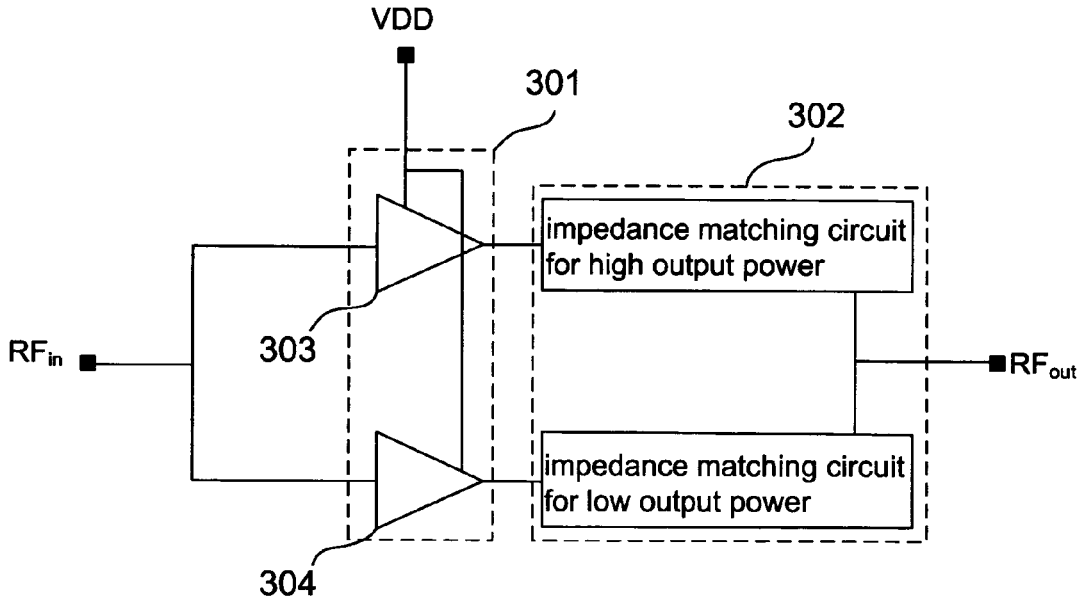
Fig. 3 (Prior Art)
FIG. 3 is a circuit block diagram illustrating an amplification stage of a power amplifier of a general art, in which low and high output power impedance matching circuits are separately illustrated.

As such, as the transmission line transformer according to the present invention is configured to include a plurality of load impedances, it can be applied to a power amplifier requiring a plurality of load impedances. Therefore, when the source voltage VDD is decreased below a predetermined value as shown in FIG. 2, only an amplification stage, which has a part having a relatively large load impedance, can be operated.

Figure 7:
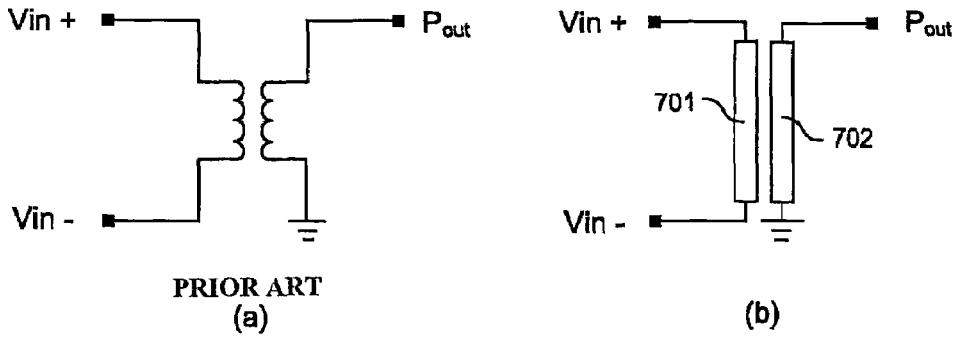
FIG. 7A is a circuit block diagram illustrating a general art transformer, used in an output power stage of a power amplifier.
FIG. 7B is a circuit block diagram illustrating a transmission line transformer, used in an output power stage of a power amplifier.

FIG. 7A is a circuit block diagram illustrating a general art transformer, used in an output power stage of a power amplifier, and FIG. 7B is a circuit block diagram illustrating a transmission line transformer, used in an output power stage of a power amplifier.

The general art transformer of FIG. 7A and the transmission line transformer of FIG. 7B serve to convert differential signals from a power amplifier to in-phase signals and to perform as an impedance matching circuit, simultaneously.

Figure 8:
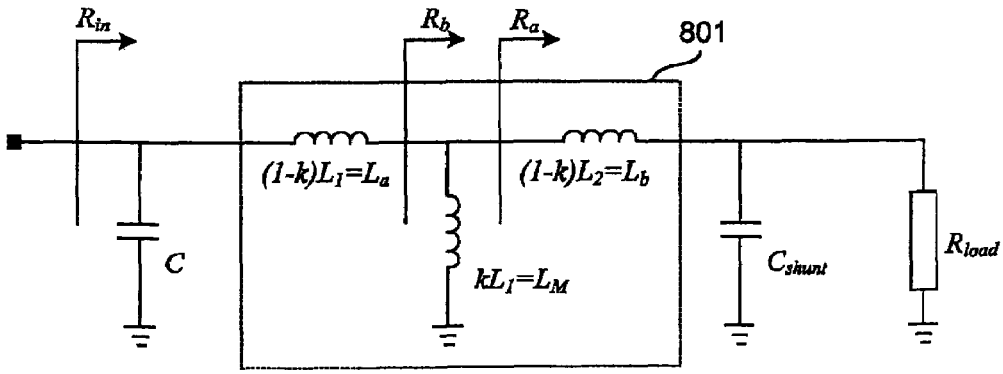
FIG. 8 is an equivalent circuit of the transmission line transformer shown in FIG. 7B, including capacitors for impedance matching of the output stage using the transmission line transformer.

In order to analyze how configuration of an impedance matching circuit can be interpreted in the case that the transmission line transformer is applied to a power amplifier, as shown in FIG. 7B, an equivalent circuit of the transmission line transformer shown in FIG. 7B, including capacitors for impedance matching of the output stage of the power amplifier, is illustrated in FIG. 8.

Here, k denotes a coupling factor, reference numeral 801 denotes an equivalent model of the transmission line transformer. The two capacitors C and $C_{shunt}$, respectively located both sides of the equivalent model, are configured in the impedance matching circuit of the output stage of the power amplifier, together with the transmission line transformer.

$$R_a = \frac{R_{load}}{1+(\omega R_{load} C_{shunt})^2} + j\omega \frac{L_b + \omega^2 R_{load}^2 L_b C_{shunt}^2 - R_{load}^2 C_{shunt}}{1+(\omega R_{load} C_{shunt})^2} \tag{2}$$

$$L_b + \omega^2 R_{load}^2 L_b C_{shunt}^2 - R_{load}^2 C_{shunt} \tag{3}$$

$$L_b = \frac{R_{load}^2 C_{shunt}}{1+(\omega R_{load} C_{shunt})^2} \tag{4}$$

$$R_a = \frac{R_{load}}{1+(\omega R_{load} C_{shunt})^2} \tag{5}$$

Equation (2) serves to calculate Ra of FIG. 8. The imaginary part of Equation (2) is equal to zero at resonance with $L_b$ and $C_{shunt}$, as described in Equation (3) . Thus Equation (2) is expressed by Equation (5). Here, $L_b$ is expressed by Equation (4).

More specifically, when operation frequency band is assumed as gigahertz for simplification of circuit analysis for the matching circuit, the circuit is analyzed as follows:

$$R_b = \frac{j\omega R_a L_M}{R_a + j\omega L_M} = \frac{\omega^2 R_a L_M^2}{R_a^2 + \omega^2 L_M^2} + j\omega \frac{R_a L_M}{R_a^2 + \omega^2 L_M^2} \tag{6}$$

$$\frac{R_a^2 L_M}{R_a^2 + \omega^2 L_M^2} = \frac{L_M}{1+\left(\frac{\omega L_M}{R_a}\right)^2} \approx 0 \tag{7}$$

$$R_{in} = \frac{R_b}{(1-\omega^2 L_a C)^2 + \omega^2 R_b^2 C^2} + j\omega \cdot \frac{L_a - R_b^2 C - \omega^2 L_a^2 C}{(1-\omega^2 L_a C)^2 + j\omega R_b C} \tag{8}$$

$$L_a - R_b^2 C - \omega^2 L_a^2 C = 0 \tag{9}$$

$$\therefore C = \frac{L_a}{R_b^2 + \omega^2 L_a^2} \tag{10}$$

$$R_{in} = \frac{R_b}{(1-\omega^2 L_a C)^2 + \omega^2 R_b^2 C^2} \tag{11}$$

$R_b$ is calculated by Equation (6). However, since the imaginary part of Equation (6) is almost zero as shown in Equations (7), the $R_{in}$ can be calculated by Equation (8). Afterwards, imaginary part of Equation (8) can be equal to zero as described in Equation (9), using value C of FIG. 8. Then, the value C can be expressed as Equation (10). Therefore, $R_{in}$ can be expressed as Equation (11).

As such, when the secondary inductance $L_b$ of the transmission line transformer is fixed, since $R_{in}$ can be changed depending on the primary inductance $L_a$, load impedance can be changed according to cross-sectional area and length of the primary transmission line. Here, $R_{in}$ can be regarded as load impedance of the power amplifier. Generally, dynamic range can be extended and efficiency of the power amplifier can be improved in the whole range of low output power when load impedance is decreased for relatively large output power and load impedance is increased for relatively small output power. Therefore, when inductance $L_a$ is decreased for a relatively large output power and increased for a relatively small output power, as described in Equation (11), the circuit can be efficiently operated.

Generally, optimum load impedance is different according to cases where a relatively large output power is generated and a relatively small output power is generated. When load impedance for a relatively high output power is properly selected in a power amplifier, such a proper load impedance for high output power causes decreased efficiency of the power amplifier in the range of low output power.

Therefore, when a power amplifier is designed to have low load impedance for high output power when high output power is needed and to have high load impedance for low output power when low output power is required, it can have high efficiency in most ranges of output power and improve its dynamic range.

When output power is controlled by a source voltage, output power is decreased with decrease of the source voltage. If load impedance is properly increased for low output power below a predetermined source voltage, dynamic range can be improved as shown in graph of FIG. 2, and, at the same time, efficiency can be increased in the region of low output power.

Figure 9:
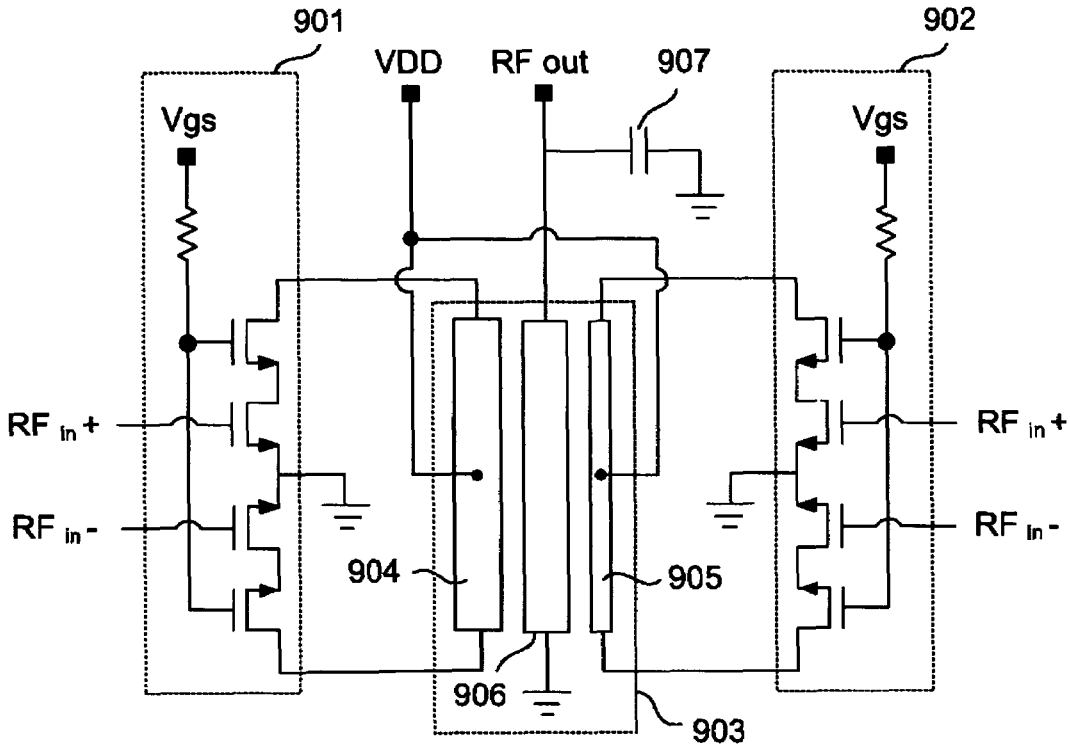
FIG. 9 is a circuit block diagram illustrating a power amplifier adopting the transmission line transformer according to the present invention.

FIG. 9 is a circuit block diagram illustrating a power amplifier adopting the transmission line transformer according to the present invention.

As shown in the figure, the transmission line transformer 903 according to the present invention is configured to have two load impedances 904 and 905. On the other hand, the output stage 901 for high output power includes relatively large-sized transistors to output high power, comparing with those of the output stage 902 for low output power.

Figure 10:
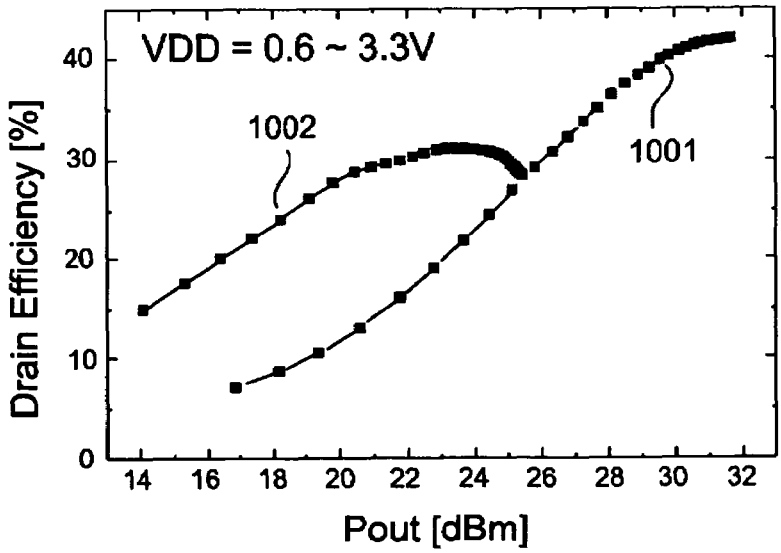
FIG. 10 is a graph describing a computer simulation result of a power amplifier adopting the transmission line transformer according to the present invention.

FIG. 10 is a graph describing a computer simulation result of a power amplifier adopting the transmission line transformer according to the present invention.

As shown in the figure, graph 1001 is a graph with respect to output power and efficiency while the source voltage VDD changes 0.6V~3.3V, in the case where both of the output stages for high output power and for low output power are operated. Graph 1002 is a graph with respect to output power and efficiency while the source voltage VDD changes 0.6V~3.3V, in the case where the output stage for high output power is turned off and the output power stage for low output power is turned on. Therefore, it will be easily appreciated that efficiency of the power amplifier is increased in the range of low output power, and dynamic range is also improved by approximately 3 dB.

The transmission line transformer according to the present invention can improve efficiency and a dynamic range of a power amplifier as its primary side is separated to form a plurality of primary transmission lines with parasitic components which are different from each other, in which the transmission line transformer is used as an impedance matching circuit of the power amplifier requiring a plurality of load impedances.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A transmission line transformer comprising:

a plurality of primary transmission lines having unequal parasitic components; and a secondary transmission line having one end connected to an output, wherein the secondary transmission line is disposed between the plurality of primary transmission lines, and the plurality of primary transmission lines have different cross-sectional areas, the cross-sections being taken in a direction perpendicular to a direction in which the plurality of transmission lines extend.

2. The transmission line transformer as set forth in claim 1, wherein one of the plurality of primary transmission lines is formed in a bent shape.

3. The transmission line transformer as set forth in claim 1, wherein the plurality of primary transmission lines and the secondary transmission line are coupled to each other with coupling factors which are different from each other.

4. The transmission line transformer as set forth in claim 1, wherein the plurality of primary transmission lines have lengths which are different from each other.

5. The transmission line transformer as set forth in claim 1, wherein the primary transmission lines and the secondary transmission line are formed in substantially similar bent shapes.

* * * * *